United States Patent [19]

Walthall

[11] Patent Number: 4,751,354

[45] Date of Patent: Jun. 14, 1988

[54] ELECTRIC OUTBOARD MOTOR CONTROL SWITCH

[75] Inventor: Kenneth Walthall, Arlington, Tex.

[73] Assignee: Molded Parts Specialists, Arlington, Tex.

[21] Appl. No.: 20,759

[22] Filed: Mar. 2, 1987

[51] Int. Cl.[4] ..... H01H 3/14; H01H 21/80

[52] U.S. Cl. ..... 200/322; 200/153 C; 200/332

[58] Field of Search ..... 200/328, 322, 321, 86.5, 200/61.79, 61.81, 332, 153 C

[56] References Cited

U.S. PATENT DOCUMENTS

| | | | |
|---|---|---|---|
| 1,772,147 | 8/1930 | Hayward | 200/86.5 |
| 2,111,311 | 3/1938 | Child | 200/332 |
| 2,818,480 | 12/1957 | Barker | 200/61.79 |

FOREIGN PATENT DOCUMENTS

| | | | |
|---|---|---|---|
| 2409656 | 9/1974 | Fed. Rep. of Germany | 200/328 |

*Primary Examiner*—Renee S. Luebke

*Attorney, Agent, or Firm*—Harold H. Dutton, Jr.

[57] ABSTRACT

A foot operated electric switch comprising a housing and a push-button actuator projecting therefrom, actuator means attached to the housing and movable between a release position out of contact with the push-button and a hold position whereby the push-button is held in a depressed condition, the actuator means comprising a generally U-shaped bracket having two legs and a cross member, the legs being pivotally attached to the housing, and the cross member depressing the push-button when in the hold position.

6 Claims, 1 Drawing Sheet

ELECTRIC OUTBOARD MOTOR CONTROL SWITCH

This invention relates to an improved control switch for use with electric outboard motors. More particularly, the invention relates to an improved switch and switch actuator by which the operator may actuate the motor either momentarily or in a continuous ON mode using the same switch.

BACKGROUND AND OBJECTS OF THE INVENTION

Electric outboard motor have become almost standard equipment on pleasure fishing boats, and are primarily used for maneuvering the boat while the occupants of the boat are fishing. Such electric outboard motors are either of the so called remote control type or of the manual type. The remote controlled motors generally have a foot pedal which is connected by a cable to a rack and pinion gear at the top of the motor column, so that by tilting the pedal either forward or backward, the direction of thrust of the motor is rotated into different positions. In addition, such remote control motors generally also include a switch for turning the motor on. The great majority of the switches are momentary contact, push-button type switches wired such that the motor operates as long as the push-button is kept depressed, and the motor is turned off when the push-button is released.

Other types of switches have been more commonly used for so called manual electric outboard motors. These motors generally do not have a steering mechanism, but the supporting shaft is mounted in a bushing, with an arm extending from the shaft so that by moving the arm in one direction or the other, the support shaft is turned and accordingly the direction of thrust of the motor is changed as desired. Most commonly, switches used with this manual type of motor are mounted in the top of the motor support bracket, and are typically on/off type toggle switches, but occasionally also include a push-button, momentary contact switch, for example in the end of the tiller arm.

Some motor controls have also used switches which were attached to the floor of the boat. Such switches have either been the momentary contact, push-button type, whereby the motor is operated so long as the push-button is depressed, or of a second type using a different type of switch. In this latter switch, pushing the push-button a single time and releasing it turns the motor on, whereas to turn the motor off the button must again be pushed.

These control switches have all suffered from various disadvantages, and among the momentary contact type of switch, the most notable disadvantage is that the operator must maintain his foot on the switch in order to keep the motor on. This of course prevents him from moving about the boat, as for example while fishing.

Similarly, the use of the type of switch which must be depressed once to turn on and depressed again to turn off prevents the operator from having the advantage of a momentary contact type switch, where a simple brief touch of the push-button generates adequate thrust to move the boat to the desired position.

Of course switches which are mounted on the head of the trolling motor most often require manual operation, which requires the fisherman to release one hand from the fishing rod in order to actuate the switch. This itself can be disadvantageous in some circumstances.

Accordingly, a primary object of this invention is to provide an improved on/off switch particularly suited for use with electric outboard motors.

Another object of this invention is to provide a control switch for an electric outboard motor which is of the momentary contact type.

Still another object of the invention is to provide a momentary contact type push-button switch which may also be kept in the constant ON mode, without the need for the operator to keep his foot on the push-button.

Yet another object of the invention is to provide an improved actuator for a foot operated switch of the push-button type, whereby a simple action is needed to convert the switch between momentary contact mode, and constant ON mode.

DESCRIPTION OF THE DRAWINGS

These and other objects and advantages of the present invention will become apparent from further consideration of the invention in light of the following specification and claims, when taken together with the accompanying drawings in which:

DESCRIPTION OF THE INVENTION

Figure 1:
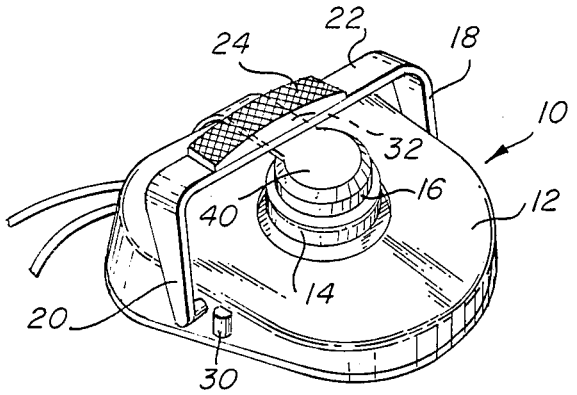
FIG. 1 is a perspective view of an improved switch according to this invention.

The switch and switch actuator according to this invention include a housing for the actual electrical contacts. Such a housing is of conventional construction, and is generally water tight, since the switch is intended for use out-of-doors in a marine environment. Typically, the switch housing has a push-button projecting from the top of the housing, the push-button usually having a molded rubber boot for sealing purposes.

An actuator bracket is pivotally attached to opposite sides of the housing. The bracket preferably is of a U-shaped configuration, with two legs connected by a cross member. The legs are each pivotally connected to the sides of the housing, and the cross member extends from one leg to the other. The actuator bracket is pivotal from a release position, for example where the cross member is located behind the housing, to a hold position wherein the cross member extends across the push-button of the switch, and holds that push-button down or "ON". Additionally, a spring member is interposed between the cross member and the housing/push-button. This spring member typically has one end attached to the housing, for example by a screw, and has the other end overlaying the push-button itself. Preferably this latter end has a downwardly cup portion which will insure that the spring member does not slide off to the side of the push-button. The spring member is spring tensioned in such a way as to be forced against the cross member of the actuator bracket. In this manner, as the actuator bracket is pivoted from the release position to the hold position, the spring member provides an smooth, sliding surface and transition between the two positions, until the cross member is directly over the push-button, which is then held on.

The spring member is generally arcuate, although it need not be precise in its configuration, since the spring tension will maintain contact between the cross member of the bracket and the spring itself.

Typically wires lead from the switch housing to the motor unit for operatively connecting the power source to the motor.

In operation, the user may simply step on the push-button in the common manner to operate the motor momentarily. Alternatively, the user may easily pivot the actuator bracket to the hold position whereby it maintains the push-button in the ON position. The electric motor will then remain on until the actuator bracket is again pushed out of the way, whereby the spring member allows the push-button to release and open the contacts, in a conventional manner.

The provision of the spring member interposed between the housing/push-button and the actuator bracket has been found to provide a very smooth transition from the OFF position to the constant ON position. The cross member slides freely along the spring member until the spring and push-button are depressed. A stop lug or projection may be formed on the sides of the housing to limit the travel of the actuator bracket to the point at which the cross member directly overlies the push-button.

DESCRIPTION OF PREFERRED EMBODIMENTS

Referring now to the drawings, the switch according to the present invention is generally designated 10 and is seen to include a housing 12 with a raised boss 14 projecting from the top surface. Typically, such a housing has a slight taper to provide slightly greater user comfort.

At the center of the boss 14 is provided the push-button actuator 16 which is connected to the contacts on the inside of the housing 12, in a conventional manner which will not be described in greater detail.

Generally, U-shaped actuator bracket 18 is seen to include two side legs 20 connected by a cross member 22. Preferably, the cross member 22 is provide with a raised roughened portion 24 which may be tread-like in texture to facilitate movement thereof. Each of the legs 20 is connected to the housing 12 by a pivotal connection. In the simplest form, this connection would take the form of a lug projecting inwardly from the legs 20, and engaging in a corresponding recess 28 in the side wall of the housing 12. In this manner, the bracket 18 may freely pivot with respect to the housing. The side walls of the housing 12 may also be provided with stop lugs 30 which serve to limit the travel of the actuator arm 18 to a point at which the cross member 22 directly overlies the push-button 16.

Figure 2:
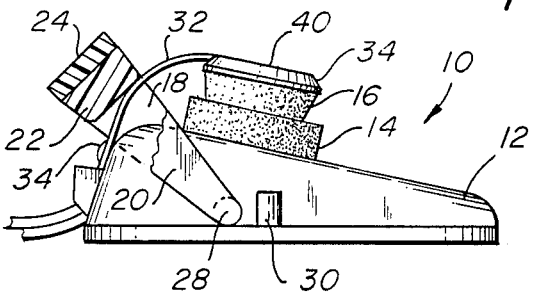
FIG. 2 is a side elevation view of the switch of FIG. 1, with parts broken away for clarity.

A spring member 32 is provided and is attached at one end to the housing by means of a screw 34 or other similar type attachment. The other end of the spring member 32 is provided with a downwardly turned cup-like portion 34 which overlies the push-button 16, as best seen in FIG. 2. This cup portion 34 helps to maintain the spring member 32 positioned directly over the push-button 16, and prevent the spring member from moving off to the side of the push-button.

The spring member 32 is biased away from the housing 12 and toward the actuator bracket 18.

The spring member 32 also is of a generally arcuate configuration, such that as the actuator moves from one position to the other the spring member maintains constant contact with the actuator. This provides for a smooth transition from the release position to the hold position.

The normal, momentary contact type operation of the switch is accomplished with the actuator bracket 18 in the position shown in FIG. 2. In this position the user may simply step on the top surface 40 of the spring member 32, to actuate the push-button 16 and turn on the motor. When released, the motor is turned off.

Figure 3:
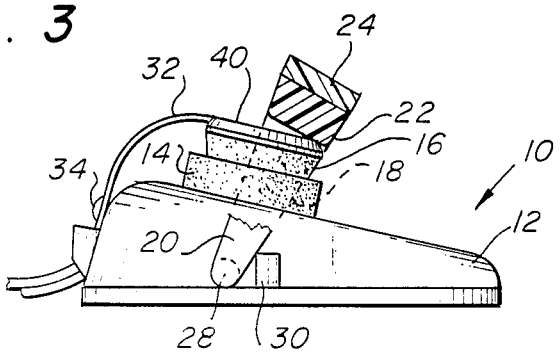
FIG. 3 is a view similar to FIG. 2 showing the switch in the constant ON mode.

To maintain the motor in the ON mode, without the need to keep his foot on the surface 40 the user may simply move the actuator bracket 18 from the position shown in FIG. 2 to the position shown in FIG. 3 in which the cross member 22 directly overlies the push-button, at which point the push-button in depressed and held in that position. In this manner, the motor will remain on until the bracket 18 is again moved to the position shown in FIG. 2.

The spring member 32 serves to smoothly operate the switch, as the actuator arm 18 is moved from one position to another. Additionally, when in the position shown in FIG. 2, the spring arm 32 will serve to keep the actuator arm 18 in the off or release position, because of the spring tension operating on the cross member 22.

While this invention has been described as having certain preferred features and embodiments, it will be understood that it is capable of still further variation and modification without departing from the spirit of the invention, and this application is intended to cover any and all variations, modifications and adaptations of the invention as fall within the spirit of the invention and the scope of the appended claims.

What is claimed is:

1. A foot operated electric switch comprising a housing and a push-button actuator projecting therefrom, actuator means attached to said housing and movable between a release position and a hold position whereby said push-button is held in a depressed condition, a spring member secured to said housing and extending over said push-button so as to be interposed between said cross member and said push-button, said actuator means comprising a generally U-shaped bracket having two legs and a cross member, said legs being pivotally attached to said housing and said cross member contacting said spring member and thereby depressing said push-button in said hold position, said spring member being generally arcuate so as to remain in contact with said cross member during movement of said actuator means between said release position and said hold position.

2. A foot operated electric switch as in claim 1 and wherein said spring member is so tensioned as to be biased toward said cross member.

3. A foot operated electric switch as in claim 1 and wherein said spring member includes two ends and is connected at one end to said housing and has a downwardly turned cup portion overlying said push-button at the other, distal end thereof.

4. A foot operated electric switch as in claim 3 and wherein said cross member has a roughened tread surface on an outwardly facing side thereof for facilitating foot actuation thereof.

5. An actuator for an electric switch having a housing and a push-button projecting therefrom, said actuator comprising a U-shaped bracket having two legs and a cross member connecting said legs, means for pivotally connecting the distal ends of said legs to the switch housing in such a manner that said bracket may be pivoted to a position wherein said cross member overlies the push-button, a spring member having two ends and adapted to be secured at one end thereof to the housing and the other end having a downwardly turned cup portion positioned so as to overly the push-button and be interposed between said cross member and the push-button, whereby said cross member urges said spring member against said push-button.

6. An actuator as in claim 5 and wherein said pivotal connecting means comprises a lug on each of said legs.

* * * * *